US009302496B2

(12) United States Patent
Chen et al.

(10) Patent No.: US 9,302,496 B2
(45) Date of Patent: Apr. 5, 2016

(54) THERMAL PRINT SYSTEM CAPABLE OF STORING INFORMATION

(71) Applicant: HiTi Digital, Inc., New Taipei (TW)

(72) Inventors: Tsung-Yueh Chen, Taipei (TW); Shiu-Sheng Hsu, New Taipei (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 239 days.

(21) Appl. No.: 14/040,725

(22) Filed: Sep. 30, 2013

(65) Prior Publication Data

US 2014/0210932 A1 Jul. 31, 2014

(30) Foreign Application Priority Data

Jan. 31, 2013 (TW) ..... 102103798 A

(51) Int. Cl.
*B41J 29/38* (2006.01)
*B41J 29/393* (2006.01)
*B41J 2/355* (2006.01)

(52) U.S. Cl.
CPC *B41J 2/355* (2013.01); *B41J 29/38* (2013.01); *B41J 29/393* (2013.01); *B41J 2202/30* (2013.01)

(58) Field of Classification Search
CPC combination set(s) only.
See application file for complete search history.

(56) References Cited

U.S. PATENT DOCUMENTS 6,523,926 B1 * 2/2003 Mitsuzawa et al. ..... 347/19
7,034,865 B2 * 4/2006 Tojo et al. ..... 348/207.2
7,213,897 B2 * 5/2007 Kosugi ..... 347/5
7,267,415 B2 * 9/2007 Saruta ..... 347/7
7,372,475 B2 5/2008 Vazac
7,768,669 B2 * 8/2010 Sakamoto et al. ..... 358/1.16
2003/0174180 A1 * 9/2003 Nunokawa ..... 347/5
2006/0203075 A1 9/2006 Vazac
2007/0081842 A1 * 4/2007 Ehrhardt, Jr. ..... 400/118.2
2009/0033581 A1 2/2009 Ross et al.

FOREIGN PATENT DOCUMENTS

CN 101269584 A 9/2008
CN 101348044 A 1/2009
CN 101365591 A 2/2009
CN 101772418 A 7/2010
CN 102173231 A 9/2011
EP 0 645 251 A1 3/1995

* cited by examiner

*Primary Examiner* — Huan Tran

(74) *Attorney, Agent, or Firm* — Winston Hsu; Scott Margo

(57) ABSTRACT

A thermal print system includes a case, a thermal print device, an information storage device, an information transmission device and a control device. The thermal print device is detachably installed inside the case and is for performing thermal printing. The information storage device is installed inside the case and is for storing parameter information of the thermal print device. The information transmission device is installed inside the case and is for fetching the parameter information stored in the information storage device. The control device is installed inside the case and is electrically connected to the information transmission device. The control device controls the thermal print device to perform the corresponding thermal printing according to the parameter information transmitted from the information transmission device.

10 Claims, 3 Drawing Sheets

THERMAL PRINT SYSTEM CAPABLE OF STORING INFORMATION

BACKGROUND OF THE INVENTION

1. Field of the Invention

The present invention relates to a thermal print system, and more specifically, to a thermal print system capable of storing printing information and parameter information.

2. Description of the Prior Art

In a conventional thermal print system, a replaceable thermal print device is often used to perform thermal printing. That is, as the thermal print device is broken or is not able to meet an expected thermal printing, it can replace the old thermal print device by another new thermal print device. However, because resistance parameters of different thermal print device are not the same, the thermal print system has to be readjusted to meet the expected thermal printing after replacing the new thermal print device. Because there is no device for storing information in the conventional thermal print device, after replacing the new thermal print device, an end user has to connect the thermal print system to a computer system to manually input related information of the new thermal print device, such as a serial number, by software, so that it can adjust the thermal print system with the new thermal print device by the software of the computer system, so as to meet the expected thermal printing. This manual adjusting method by the end user is very inconvenient and results in thermal printing with bad quality. Therefore, it is an important issue to design a thermal print system capable of adjusting parameters of the thermal print system automatically.

SUMMARY OF THE INVENTION

The present invention is to provide a thermal print system capable of adjusting parameters of thermal printing system automatically to solve above problems.

According to the disclosure, a thermal print system includes a case, a thermal print device, an information storage device, an information transmission device and a control device. The thermal print device is detachably installed inside the case and is for performing thermal printing. The information storage device is installed inside the case and is for storing parameter information of the thermal print device. The information transmission device is installed inside the case and is for fetching the parameter information stored in the information storage device. The control device is installed inside the case and is electrically connected to the information transmission device. The control device controls the thermal print device to perform the corresponding thermal printing according to the parameter information transmitted from the information transmission device.

According to the disclosure, the thermal print system further includes a driving module electrically connected to the control device for driving the thermal print device, and the control device being further for controlling the driving module to drive the thermal print device to perform the thermal printing according to the parameter information.

According to the disclosure, the information storage device is installed on the thermal print device.

According to the disclosure, the information transmission device and the control device are installed on a control circuit board together.

According to the disclosure, the information storage device and the thermal print device are disposed separately.

According to the disclosure, the control device is further for controlling the information transmission device to store using information in the information storage device.

According to the disclosure, the information storage device is a wireless device.

According to the disclosure, the wireless device is a radio frequency identification device, a microwave identification device, an infrared recognition device or a Bluetooth identification device.

According to the disclosure, the information storage device is for storing the parameter information of a resistance parameter, a date of manufacture, a production area, or a drive voltage.

The thermal print system of the present invention is to perform the corresponding printing operation by fetching the parameter information of the thermal print device stored in the information storage device. As a result, the end user has not to manually input the related information, such as a serial number by the software, and it is able to load the corresponding optimization setting of the thermal print device directly to avoid the mistakes resulted from the manual adjustment, so as to achieve the purpose of printing optimization and setting automatically. Therefore, the present invention improves a disadvantage of inputting the related information manually by the end user to control the thermal print system to perform the optimized thermal printing.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
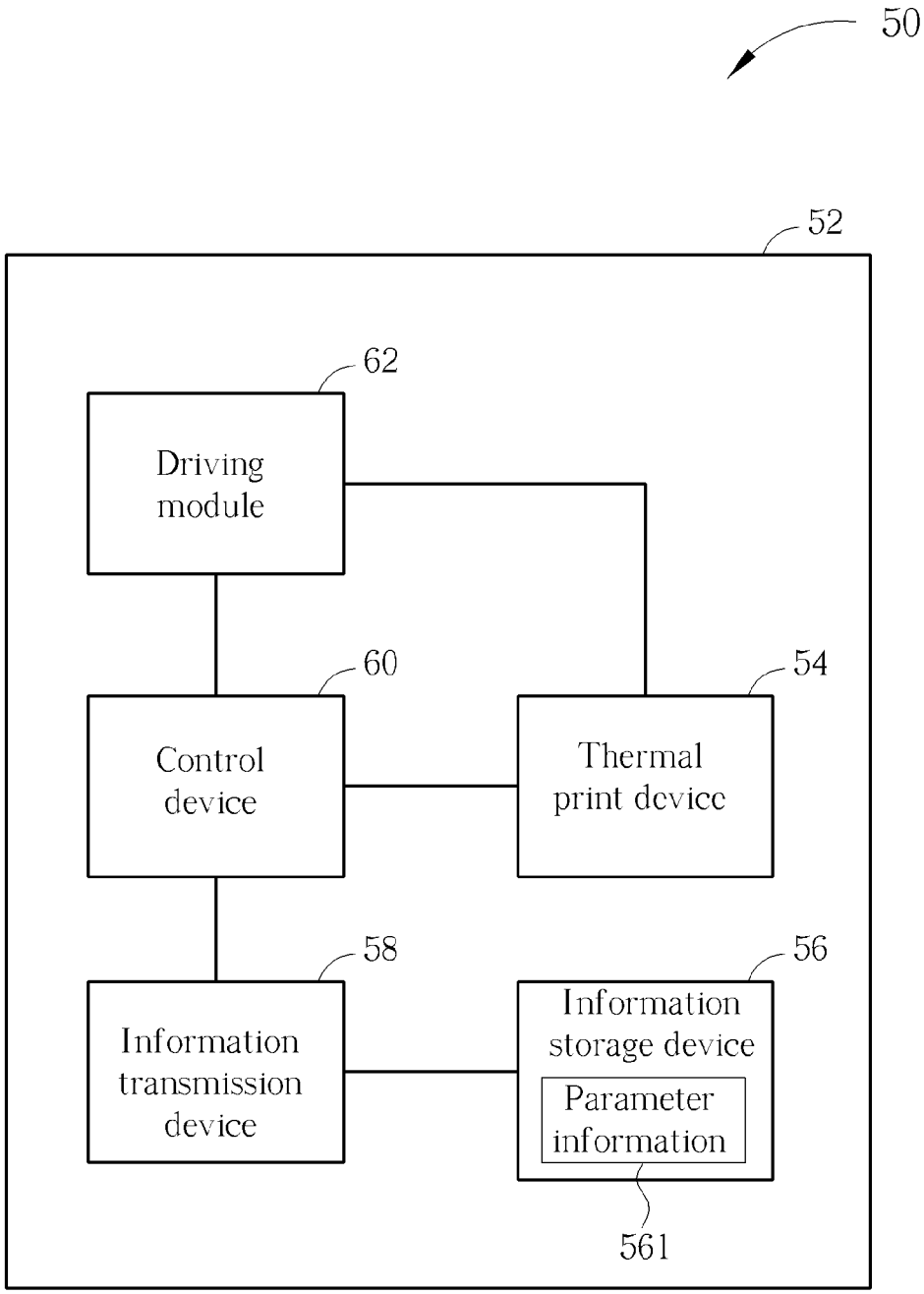
FIG. 1 is a functional block diagram of a thermal print system according to an embodiment of the present invention.

Please refer to FIG. 1. FIG. 1 is a functional block diagram of a thermal print system 50 according to an embodiment of the present invention. The thermal print system 50 includes a case 52, a thermal print device 54, an information storage device 56, an information transmission device 58, a control device 60 and a driving module 62. The thermal print system 50 can be a thermal printer system, and the thermal print device 54 can be thermal print head device which is detachably installed inside the case 52 of the thermal print system 50. Therefore, as the thermal print device 54 is abnormal or broken, a user can replace the old thermal print device 54 by a new thermal print device 54 instead of replacing the whole thermal print system 50, so as to achieve a purpose of modularizing components and decreasing the manufacturing cost. The thermal print device 54 is for performing thermal printing. For example, it can print a designed graphic on a mug, clothes or a card by thermal printing. The information storage device 56 is installed inside the case 52 and is for storing parameter information 561 of the thermal print device 54. For example, the information storage device 56 can store the parameter information of a resistance parameter, a drive voltage, a date of manufacture, a production area, a drive voltage, and so on. The information storage device 56 can be a chipset device for storing the parameter information 561 of the thermal print device 54 by radio frequency identification, Near Field Communication, Bluetooth, infrared, microwave, and so on. That is, the information storage device 56 can be a wireless device, such as a radio frequency identification device, a chipset identification device, a microwave identification device, an infrared recognition device, a Bluetooth identification device, and so on.

Furthermore, the information transmission device 58 is installed inside the case 52 and is for fetching the parameter information 561 stored in the information storage device 56. A transmission interface of the information transmission device 58 corresponds to data transmission format of the information storage device 56, and the data transmission can conform to radio frequency identification, Near Field Communication, Bluetooth, infrared, microwave or 2D barcode. The control device 60 is installed inside the case 52 and electrically connected to the information transmission device 58. The control device 60 can be a chipset for controlling the thermal print device 54 of the thermal print system 50 to perform the corresponding thermal printing according to the parameter information 561 transmitted from the information transmission device 58. The driving module 62 is electrically connected to the control device 60 for driving the thermal print device 54. The control device 60 can be further for controlling the driving module 62 to drive the thermal print device 54 to perform the thermal printing according to the parameter information 561.

In this embodiment, the information storage device 56 and the thermal print device 54 can be disposed separately inside the case 52. For example, the thermal print device 54 and the information storage device 56 can be respectively disposed on different substrates, so that it can install or replace the thermal print device 54 and the information storage device 56 separately and independently. Furthermore, the information transmission device 58 can be positioned close to the thermal print device 54 and far way from the control device 60, so that the inner mechanical space can be arranged flexibly by this design. As the information storage device 56 is installed inside the thermal print system 50, the control device 60 is able to fetch the parameter information 561 stored by the information storage device 56 via the information transmission device 58. For example, the control device 60 can fetch the parameter information of the resistance parameter, the drive voltage, the date of manufacture, the production area, or drive voltage of the corresponding thermal print device 54, so as to control the thermal print system 50 to perform a corresponding operation. The parameter information 561 can be the default factory setting of the thermal print device 54, so that an end user has not to manually input the related information, such as a serial number, and it is able to load a corresponding optimization setting of the thermal print device 54 directly to avoid mistakes resulted from a manual adjustment, so as to achieve a purpose of printing optimization and setting automatically. For example, the control device 60 can control every mechanical component of the driving module 62, such as adjusting a motor speed or a mechanical angle, according to the parameter information 561 provided by the information storage device 56, so as to achieve a purpose of optimizing thermal printing results of the thermal print device 54.

Moreover, the present invention can be designed that the control device 60 is further for controlling the information transmission device 58 to store using information in the information storage device 56 after the thermal print device 54 has been used for a long while. That is, the parameter information 561, such as the parameter information about machines in which the thermal print device 54 has been installed, a printing time, the numbers of printing, and so on, is stored by the transmission methods described above. As the thermal print device 54 is changed to another machine, the corresponding information storage device 56 also can be changed to the same machine, so that the machine also can fetch the parameter information 561 stored in the information storage device 56 to require the using information of the corresponding thermal print device 54, and the using information can be as a basis for setting the printing parameter.

Figure 2:
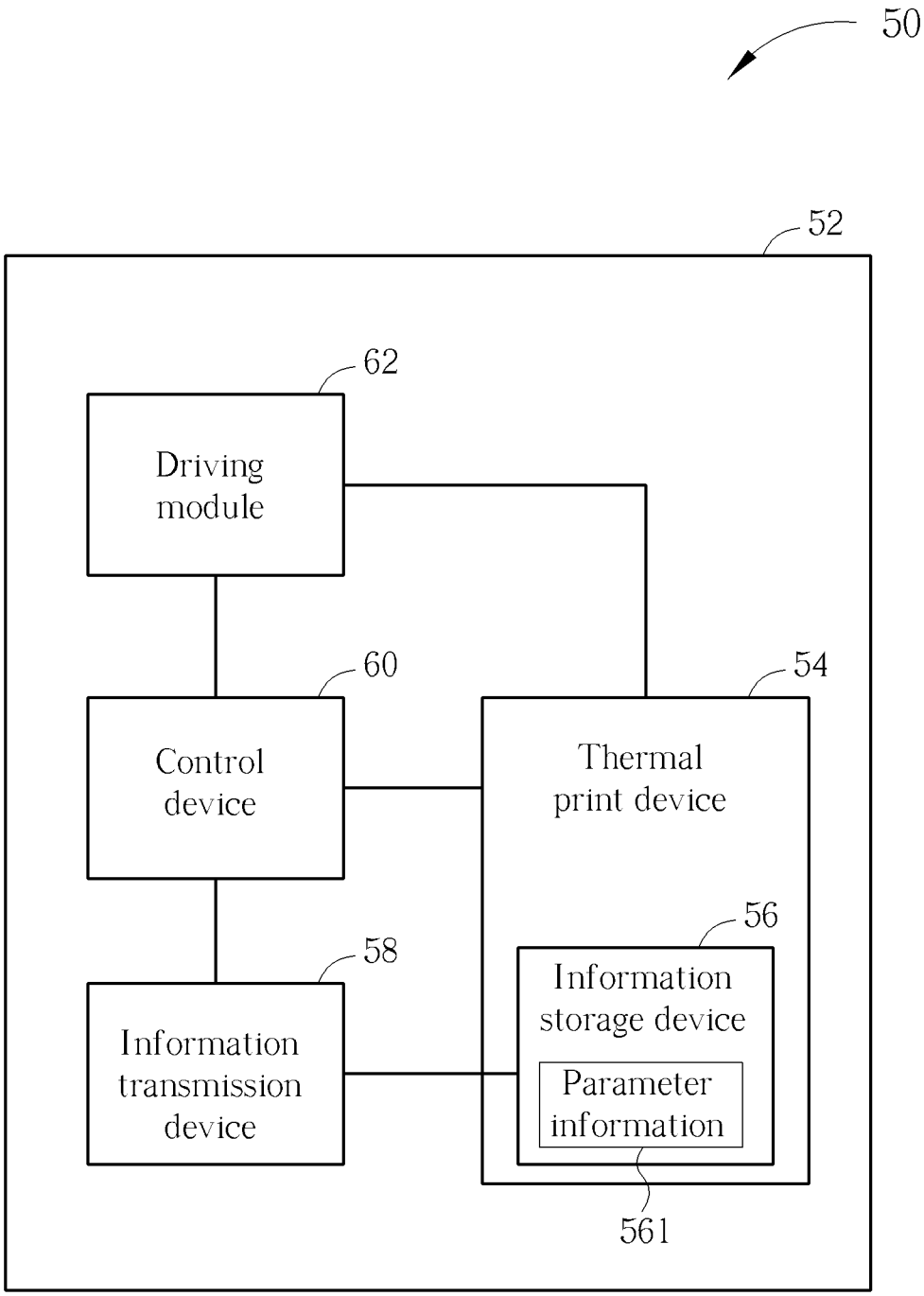
FIG. 2 is a functional block diagram of the thermal print system according to another embodiment of the present invention.

Please refer to FIG. 2. FIG. 2 is a functional block diagram of the thermal print system 50 according to another embodiment of the present invention. In this embodiment, the information storage device 56 is installed on the thermal print device 54. For example, the information storage device 56 can be a chipset device fixed on the thermal print device 54. Therefore, as the thermal print device 54 is replaced, the information storage device 56 is also replaced at the same time. The same as a description of the previous embodiment, the control device 60 can fetch the parameter information 561 stored in the information storage device 56 via the information transmission device 58. For example, the control device 60 can fetch the parameter information of the resistance parameter, the drive voltage, the date of manufacture, the production area, or drive voltage of the corresponding thermal print device 54, so as to control the thermal print system 50 to perform the corresponding operation. Therefore, the end user has not to manually input the related information, such as a serial number by the software, and it is able to load the corresponding optimization setting of the thermal print device 54 directly.

Figure 3:
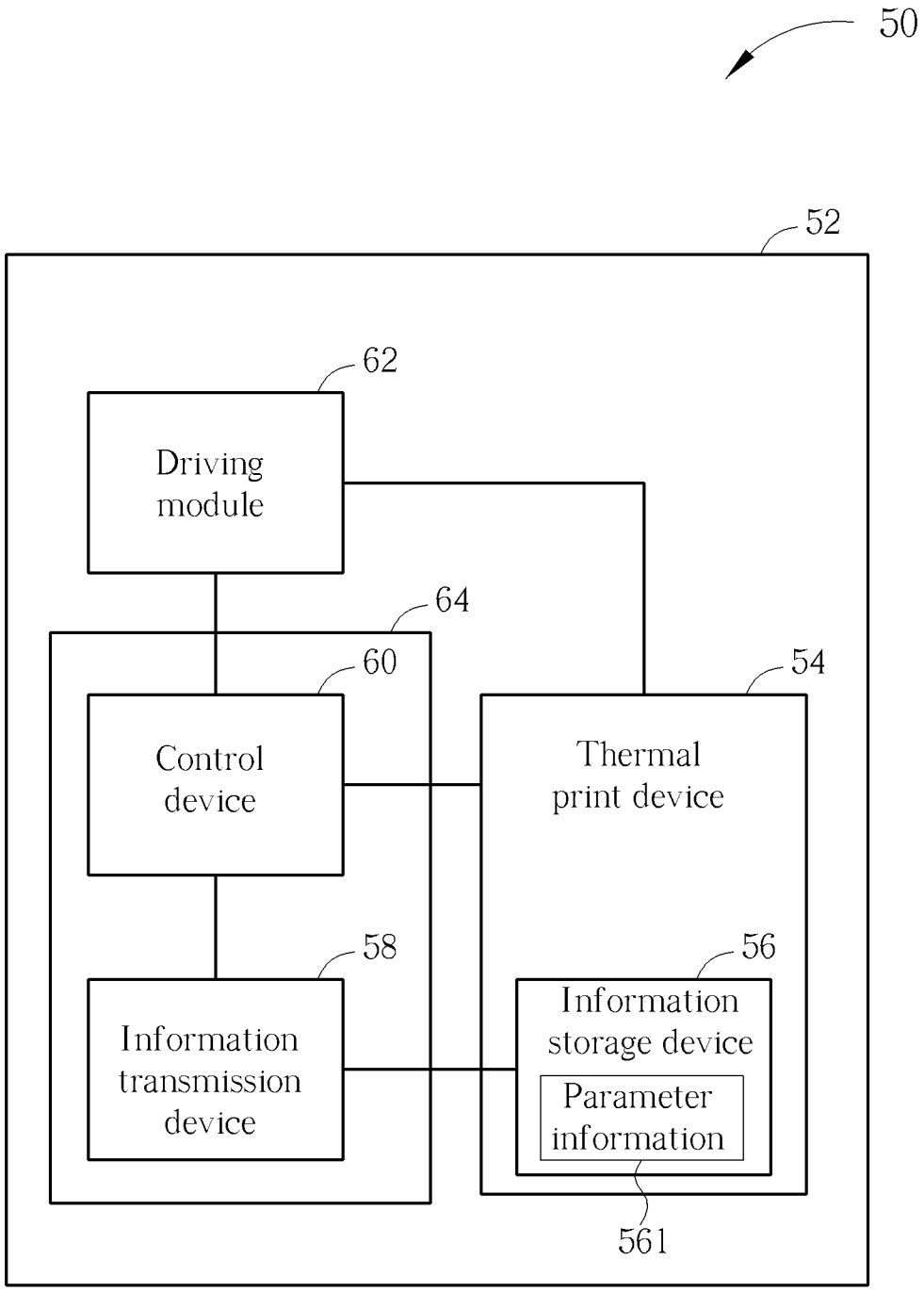
FIG. 3 is a functional block diagram of the thermal print system according to another embodiment of the present invention.

Please refer to FIG. 3. FIG. 3 is a functional block diagram of the thermal print system 50 according to another embodiment of the present invention. A difference between this embodiment and the previous embodiments is that the information transmission device 58 and the control device 60 can be installed on a control circuit board 64 together in this embodiment. That is, the information transmission device 58 and the control device 60 can be integrated on the same chipset of the control circuit board 64. This configuration can achieve a purpose of integrating components and decreasing the manufacturing cost. In addition, a design for installing the information transmission device 58 and the control device 60 on the same control circuit board 64 also can be applied to another embodiment whose the thermal print device 54 and the information storage device 56 installed on different substrates. An operational mechanism of this embodiment is the same as the previous embodiment, and detailed description is omitted herein.

In contrast to the prior art, the thermal print system of the present invention is to perform the corresponding printing operation by fetching the parameter information of the thermal print device stored in the information storage device. As a result, the end user has not to manually input the related information, such as a serial number by the software, and it is able to load the corresponding optimization setting of the thermal print device directly to avoid the mistakes resulted from the manual adjustment, so as to achieve the purpose of printing optimization and setting automatically. Therefore, the present invention improves a disadvantage of inputting the related information manually by the end user to control the thermal print system to perform the optimized thermal printing.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A thermal print system comprising:

a case;

a thermal print device detachably installed inside the case and being for performing thermal printing;

an information storage device installed inside the case and being for storing parameter information of the thermal print device;

an information transmission device installed inside the case and being for fetching the parameter information stored in the information storage device;

a driving module for mechanically driving the thermal print system; and a control device installed inside the case and electrically connected to the information transmission device and the driving module, the control device being for controlling the thermal print device to perform the corresponding thermal printing according to the parameter information transmitted from the information transmission device and further for controlling the driving module to mechanically drive the thermal print device to perform the corresponding thermal printing according to the parameter information.

2. The thermal print system of claim 1, wherein the information storage device is installed on the thermal print device.

3. The thermal print system of claim 2, wherein the information transmission device and the control device are installed on a control circuit board together.

4. The thermal print system of claim 1, wherein the information storage device and the thermal print device are disposed separately.

5. The thermal print system of claim 4, wherein the information transmission device and the control device are installed on a control circuit board together.

6. The thermal print system of claim 1, wherein the information transmission device and the control device are installed on a control circuit board together.

7. The thermal print system of claim 1, wherein the control device is further for controlling the information transmission device to store utilization information in the information storage device.

8. The thermal print system of claim 1, wherein the information storage device is a wireless device.

9. The thermal print system of claim 8, wherein the wireless device is a radio frequency identification device, a microwave identification device, an infrared recognition device or a Bluetooth identification device.

10. The thermal print system of claim 1, wherein the information storage device is for storing the parameter information of a resistance parameter, a date of manufacture, a production area, or a drive voltage.

* * * * *